US007125148B2

(12) United States Patent
Hayes

(10) Patent No.: US 7,125,148 B2
(45) Date of Patent: Oct. 24, 2006

(54) REFLECTOR FOR FLUORESCENT LAMP

(75) Inventor: Richard Leslie John Hayes, Cannock (GB)

(73) Assignee: Scientific Lighting Products, Maryland Heights, MO (US)

( * ) Notice: Subject to any disclaimer, the term of this patent is extended or adjusted under 35 U.S.C. 154(b) by 0 days.

(21) Appl. No.: 11/008,036

(22) Filed: Dec. 9, 2004

(65) Prior Publication Data

US 2006/0126339 A1 Jun. 15, 2006

(51) Int. Cl.
*F21V 7/00* (2006.01)

(52) U.S. Cl. ..... 362/346; 362/342; 362/347

(58) Field of Classification Search ..... 362/217, 362/260, 297, 304, 346, 347, 342
See application file for complete search history.

(56) References Cited

U.S. PATENT DOCUMENTS 5,758,954 A * 6/1998 Holten et al. ..... 362/342
5,944,411 A * 8/1999 Holten et al. ..... 362/342

* cited by examiner

*Primary Examiner*—Stephen F Husar
(74) *Attorney, Agent, or Firm*—J. David Wharton; Stinson Morrison Hecker LLP

(57) ABSTRACT

A reflector for a fluorescent lamp formed in an integral molded unit is presented. The reflector has arcuate side portions which present a receptacle area for receiving a fluorescent light tube. The side portions are joined together by a plurality of u-shaped cross braces which extend between the side portions at spaced locations along their length. Each of the cross braces is formed by two intersecting planar surfaces which extend at acute angles relative to a common plane a the point of intersection. The result is less light loss through diffusion, improved reflectivity.

6 Claims, 2 Drawing Sheets

REFLECTOR FOR FLUORESCENT LAMP

BACKGROUND OF THE INVENTION

Field of the Invention

This invention relates generally to fluorescent lighting and, more particularly, to a fluorescent light reflector. More specifically, the invention is directed to a reflector which includes a unique configuration cross baffle that improves reflectivity and substantially reduces the cost of manufacturing.

Prior art reflectors for fluorescent lamps have included fixtures which are normally ceiling mounted with a flat top and arcuate side portions which extend from the top and present a reflective surface. A cross baffle or louver extends between the two arcuate side portions to complete the assembly. These louvers or cross baffles have heretofore been formed from reflective sheet metal. Manifestly, the louver or baffle must be cut to fit around the lamp. While a flat baffle may be utilized, this reduces the ability to produce the desired luminous output.

Reflective louvers of the prior art have heretofore been constructed of metal requiring multiple fabrication steps to achieve the desired configuration. Limitations in metal fabrication processing, however, limit the extent to which the reflectivity of the baffles may be optimized.

BRIEF SUMMARY OF THE INVENTION

The present invention addresses the deficiencies of the prior art by forming the fluorescent lamp reflector from metalized molded parts. The baffle is configured in a generally u-shape with the sides of the u being presented by intersecting planar surfaces that extend at acute angles relative to a common plane at the point of intersection. This configuration has many advantages including improved strength of the reflector, improved reflectivity, less light loss through diffusion, and reduced fabrication costs since a moldable material is employed.

The many advantages and novel features of the invention are set forth in the following description and claims which should be read in light of the accompanying drawings. It will be understood that additional aspects of the invention not specifically described will be apparent to those skilled in the art or may become apparent from those practicing the invention. The objects and advantages of the invention may be realized through the instrumentalities and combinations particularly set forth in the appended claims as well as all equivalents thereof.

DETAILED DESCRIPTION OF PREFERRED EMBODIMENT

Figure 1:
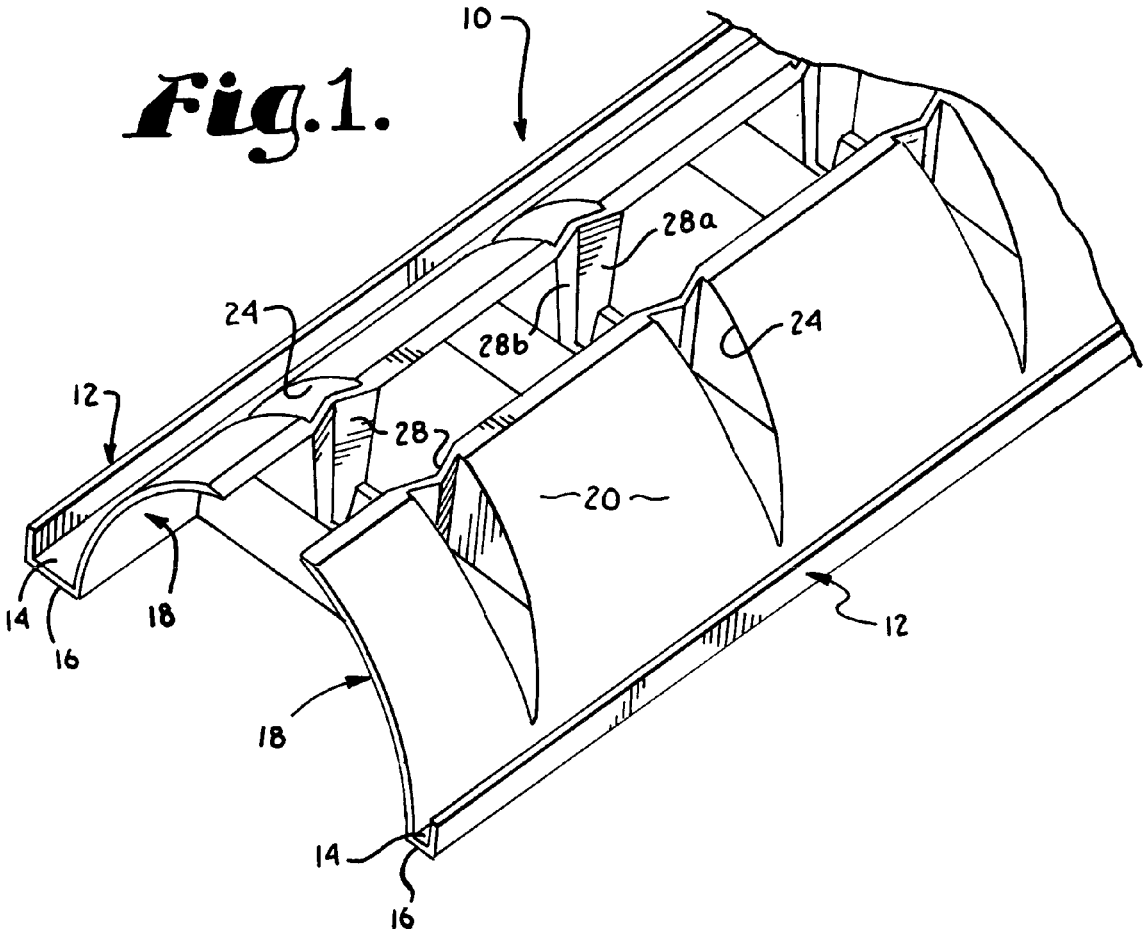
FIG. 1 is a partial perspective view of the reflector according to the present invention.

Referring initially to FIG. 1, a reflector according to the present invention is designated generally by the numeral 10.

Reflector 10 includes two parallel L-shaped side rails 12, one leg 14 of which, in cooperation with the corresponding leg on the opposite rail forms a flat top surface 16 (surface 16 will be at the top against the ceiling during normal use).

Integral with each side rail 12 is an arcuate side portion 18. Since each side portion 18 is identical to the other, except for being a mirror image, only one such portion will be described in detail. Side portion 18 comprises a curved wall 20 having an inner reflective surface 22. Each wall 20 also includes a plurality of space open areas 24 to be explained more fully hereinafter.

Figure 2:
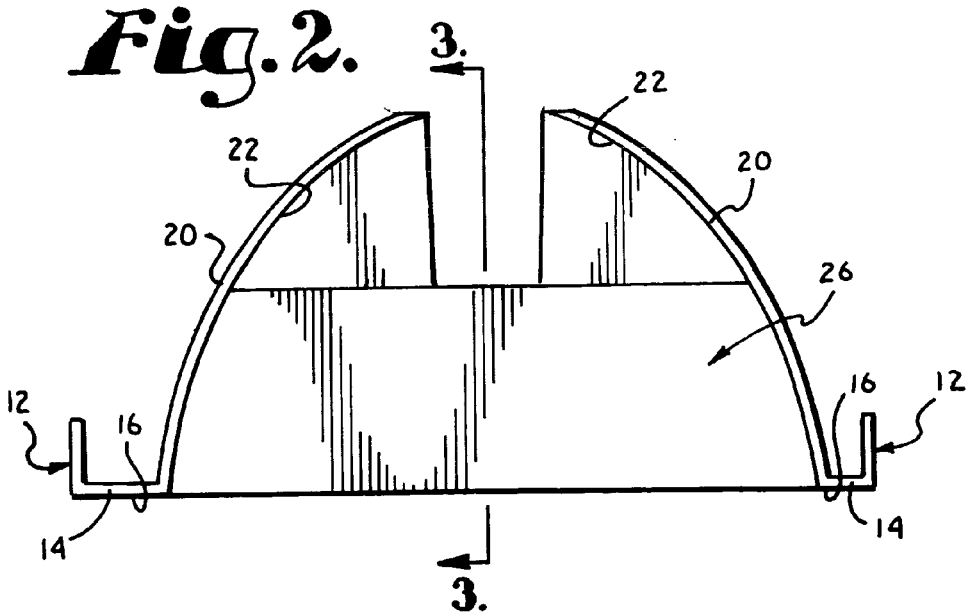
FIG. 2 is an end elevation of the reflector shown in FIG. 1.

A plurality of generally u-shaped cross braces or baffles designated generally by the numeral 26 extend from one curved wall to the other at open areas 24. Each cross brace 26 comprises parallel leg portions 28 which are mirror images of each other and a bight portion 30. Referring to FIG. 2, it will be appreciated that a fluorescent lamp tube is received within the channel presented by walls 20 and cross braces 26.

Figure 3:
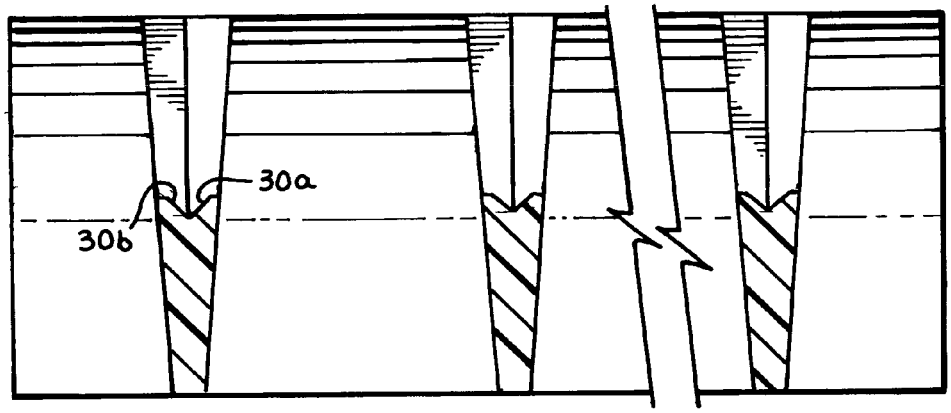
FIG. 3 is a vertical cross-sectional view taken along line 3—3 of FIG. 2.
Figure 4:
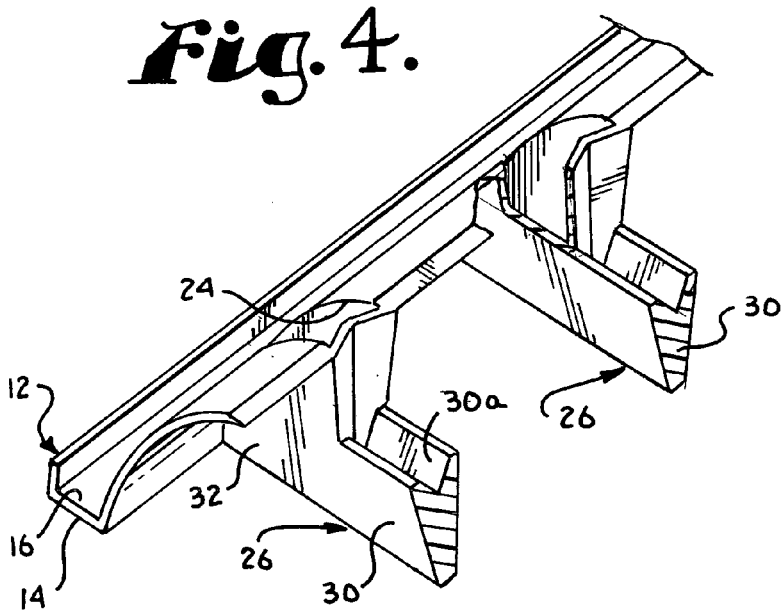
FIG. 4 is a perspective view of the portion of the reflector shown in cross section in FIG. 3.

Each leg portion 28 is comprised of two intersecting planar surfaces 28*a* and 28*b* which extend at an acute angle relative to a common plane at the point of intersection of the two surfaces. Preferably, the angle of extension of each surface relative to the aforementioned plane is between 15 to 75 degrees, and most preferably approximately 20 degrees. Bight portion 30, as best illustrated in FIGS. 3 and 4, is also characterized by two intersecting planar surfaces 30*a* and 30*b* which extend at an acute angle relative to a common plane at the point of intersection. It will be appreciated that the angle of surfaces 30*a* and 30*b*, although different from the angle of surfaces 28*a* and 28*b* is dependent upon and determined by the latter surfaces. Surfaces 30*a* and 30*b* are at an angle which will result in their side edges being coterminous with the side edges of surfaces 28*a* and 28*b*. It is also to be noted that bight portion 30 includes planar end panels 32 which extend beyond planar surfaces 28*a* and 28*b* and intersect with reflective inner surfaces 22 as best seen in FIG. 4.

It will be understood and appreciated that surfaces 22, 28*a*, 28*b*, 30*a* and 30*b* are all metalisized or treated in some equivalent manner so as to enhance their reflective properties.

The reflector according to the present invention is feasible when formed by a molding process which results in an integral unit. To this end, it will be appreciated that the presence of open areas 24 accommodate a mold which can form leg portions 28*a* and 28*b* in the desired configuration. Without cutaway portions, without open areas 24, this configuration would be impractical.

A reflector according to the present invention can be formed from a moldable material utilizing known molding processes. This results in a more economical construction than prior art reflectors fabricated from metal. By using a molding process, multiple reflective surfaces 28*a*, 28*b*, 30*a* and 30*b* on cross braces 26 are presented which not only increases the reflective surface area, but also decreases light loss through diffusion. This results in greatly improved efficiency for the lamp and reflector combination. While an advantage of the invention is the ability to mold the reflector 10 as a single unit it should be understood that cross braces 26 could be formed as separate pieces without departing from the scope of the invention.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A reflector for an elongated fluorescent light tube, said reflector comprising:

a body having a top;

arcuate side portions extending away from said top to present a reflective surface, said side portions being spaced apart relative to each other to present an opening for receiving said fluorescent light tube; and a plurality of generally u-shaped cross braces connecting said side portions at spaced locations along the length of the latter, each of said cross braces presenting two intersecting planar surfaces on the inside surface of the u, which surfaces extend at acute angles relative to a common plane at the point of intersection, said common plane extending in the direction of said cross brace, said surface reflecting light from said tube toward said opening.

2. A reflector as set forth in claim 1, wherein said cross braces are generally u-shaped and all three sides are comprised of two intersecting planar surfaces.

3. A reflector as set forth in claim 1, wherein said acute angle is between 15 and 75 degrees.

4. A reflector as set forth in claim 3, wherein said side portions include open areas where said cross braces are formed.

5. A reflector as set forth in claim 4, wherein said body side portions and said cross braces are molded as an integral unit.

6. A reflector as set forth in claim 5, wherein said cross brace extends from said top to the periphery of said opening.

* * * * *